US008684590B2

(12) United States Patent
Giangrande et al.

(10) Patent No.: US 8,684,590 B2
(45) Date of Patent: Apr. 1, 2014

(54) DEVICE FOR MIXING POWDER WITH A LIQUID, THE DEVICE INCLUDING A DISPERSION TUBE

(75) Inventors: Carlo Giangrande, Sartrouville (FR); Francois-Eudes Lefevre, Sartouville (FR)

(73) Assignee: Sodimate, Sartrouville (FR)

( * ) Notice: Subject to any disclaimer, the term of this patent is extended or adjusted under 35 U.S.C. 154(b) by 961 days.

(21) Appl. No.: 12/772,339

(22) Filed: May 3, 2010

(65) Prior Publication Data

US 2010/0278006 A1 Nov. 4, 2010

(30) Foreign Application Priority Data

May 4, 2009 (FR) ..... 09 52948

(51) Int. Cl.
*B01F 5/12* (2006.01)

(52) U.S. Cl.
USPC ..... 366/138; 366/163.2; 366/164.1; 366/264; 366/270; 366/299

(58) Field of Classification Search
USPC ..... 366/262–266, 270, 308, 138, 154.1, 366/155.1, 297–300, 163.2, 164.1, 164.6, 366/168.1, 172.1, 172.2; 261/91, 120; 417/61; 415/7; 210/170.01–170.11, 210/121, 242.1–242.4, 220–221.2; 416/142–143
See application file for complete search history.

(56) References Cited

U.S. PATENT DOCUMENTS

| | | | | | |
|---|---|---|---|---|---|
| 2,685,499 | A * | 8/1954 | Hood | ..... | 423/554 |
| 3,911,065 | A * | 10/1975 | Martin et al. | ..... | 261/91 |
| 2003/0011082 | A1 * | 1/2003 | Tanabe et al. | ..... | 261/91 |
| 2004/0218463 | A1 | 11/2004 | Allen | | |
| 2007/0183257 | A1 * | 8/2007 | Van Den Berg | ..... | 366/264 |
| 2010/0278006 | A1 * | 11/2010 | Giangrande et al. | ..... | 366/138 |

FOREIGN PATENT DOCUMENTS

| | | | | | |
|---|---|---|---|---|---|
| DE | 92 13 898 | U1 | 12/1992 | | |
| JP | 07196393 | A * | 8/1995 | ..... | C30B 7/02 |
| WO | WO 02/092206 | A2 | 11/2002 | | |
| WO | WO 03/086565 | A2 | 10/2003 | | |

* cited by examiner

*Primary Examiner* — Charles E Cooley
(74) *Attorney, Agent, or Firm* — Hamre, Schumann, Mueller & Larson, P.C.

(57) ABSTRACT

A device for mixing powder of the like with a liquid, the device including both a dispersion tube having its bottom portion open and designed to be in the liquid and having a delivery orifice for powder or the like in its top portion, and a mixer located in the dispersion tube and including a first rotary stirrer disposed in the vicinity of the bottom end of the dispersion tube and suitable for creating a first downward stream in the dispersion tube. The mixer further includes a second rotary stirrer disposed between the delivery orifice for powder or the like and the first rotary stirrer, and suitable for creating a second downward stream in the dispersion tube.

18 Claims, 3 Drawing Sheets

DEVICE FOR MIXING POWDER WITH A LIQUID, THE DEVICE INCLUDING A DISPERSION TUBE

FIELD OF THE INVENTION

The present invention relates to a device for mixing powder or the like with a liquid, and to a method of mixing powder or the like with a liquid.

More particularly, the invention relates to a mixer device for mixing powder or the like with a liquid, the device comprising both a dispersion tube having its bottom portion open and designed to be in the liquid and having a delivery orifice for powder or the like in its top portion, and mixer means located in the dispersion tube and comprising a first rotary stirrer disposed in the vicinity of the bottom end of the dispersion tube and suitable for creating a first downward stream in said dispersion tube.

BACKGROUND OF THE INVENTION

The term "powder or the like" is used to mean any solid in a powder, granular, divided, or equivalent state that is light in weight, with a grain size of less than five millimeters (5 mm), that generates dust when handled, and that is suitable for mixing with a liquid. Below, the term "powder" is used more generically for "powder or the like".

More precisely, in the device for mixing powder with a liquid as disclosed in DE 43 23 371, the first stirrer is immersed and, with the help of the first downward stream, generates a powder/liquid mixing interface at the surface of the liquid. Naturally, the top portion of the dispersion tube is outside the liquid.

Nevertheless, when powder is introduced into the dispersion tube, the powder reaches the surface of the liquid in order to be mixed therewith by being subjected to gravity, i.e. to its own weight. The lighter particles of the powder, i.e. the dust of the powder, remain in suspension in the emergent portion of the dispersion tube. In other words, this arrival of powder generates dust that is lighter than the powder and that disperses in the emergent portion of the dispersion tube. With continued use, this dust runs the risk of accumulating in the emergent portion of the dispersion tube and of leading to a malfunction of the dispersion tube, in particular by giving rise to a poor flow of powder, thereby leading to poor mixing, with possible formation of lumps of powder in the liquid. The dispersion tube then performs less well and may even become unusable. It is then necessary to dismantle it and clean it in order to return it to its initial operating state.

OBJECT AND SUMMARY OF THE INVENTION

An object of the present invention is to provide a mixer device that substantially remedies those drawbacks.

This object is achieved by the fact that the mixer means of the above-mentioned device for mixing powder or the like further comprise a second rotary stirrer disposed between the delivery orifice for powder or the like and the first rotary stirrer, and suitable for creating a second downward stream in said dispersion tube.

It should be understood that the second stirrer is located beneath the level of the powder delivery orifice but above the level of the first stirrer. The second stirrer is suitable for creating a second downward stream, i.e. a stream capable of taking the powder and dust situated in the region of the powder delivery orifice (i.e. above the first stirrer) and delivering it towards the region of the first stirrer (i.e. beneath the second stirrer).

Thus, when the liquid level is adjusted to lie beneath the second rotary stirrer, the second downward stream serves to convey the powder and dust in forced manner towards the surface of the liquid. The first stirrer generates a powder/liquid mixing interface at the surface of the liquid for mixing the powder and dust with the liquid.

Consequently, even though it is lighter than the powder, the dust is entrained by the second downward stream and is delivered to the surface of the liquid. Thus, both the powder and also the dust generated on introducing the powder into the dispersion tube are delivered in forced manner by the second downward stream to the level of the surface of the liquid, and they are mixed with the liquid with the help of the first downward stream that creates a powder/liquid mixing interface at the surface of the liquid. Thus, the dust is also mixed with the liquid and it does not accumulate in the emergent portion of the dispersion tube, unlike that which occurs in known mixer devices.

When the liquid level is adjusted to lie above the second stirrer, although naturally below the powder delivery orifice, then both stirrers are immersed. The second downward stream then serves to create the powder/liquid mixing interface. The first stirrer serves to create a first downward stream in continuity with the second downward stream. This first downward stream takes over from the second downward stream along the immersed portion inside the dispersion tube. Thus, the combined presence of both stirrers in the immersed portion of the tube improves the efficiency of powder mixing. Compared with known devices, the presence of two immersed stirrers ensures firstly that the stirrer that is closer to the surface (i.e. the second stirrer) creates the powder/liquid mixing interface and secondly that the stirrer that is deeper in the liquid (i.e. the first stirrer) conveys the liquid in forced manner from the dispersion tube to outside the dispersion tube. This forced conveyance improves renewal of the liquid at the powder/liquid mixing interface. The effectiveness of the interface is thereby improved and dust as well as powder is more easily mixed with the liquid than in prior art devices.

Consequently, the presence of the second stirrer creating a second downward stream, even when the second stirrer is immersed, improves the mixing of the powder and any dust with the liquid, thereby avoiding accumulation of powder and dust in the emergent portion of the dispersion tube.

Naturally, provision may be made for one or more additional stirrers to be present in the dispersion tube in order to adjust the downward streams more finely.

It should also be understood that the device of the invention for mixing powder with a liquid may include, or be used in, a liquid vessel or channel or pipe or the equivalent, with the bottom portion of the dispersion tube being open in the liquid vessel, channel, pipe, or equivalent.

Advantageously, both rotary stirrers are driven by a common drive shaft. Advantageously, at least one of the stirrers, and preferably both stirrers, are propellers. Advantageously, in order to improve the overall efficiency of the two stirrers, the pitch of the first propeller is smaller than the pitch of the second propeller, and the diameter of the first propeller is larger than the diameter of the second propeller.

The pitch of a propeller is the inclination of the propeller blades relative to a plane perpendicular to the axis of rotation of the propeller. A propeller with a small pitch presents blades of small inclination, while a propeller with a larger pitch presents blades of greater inclination. Consequently, other things remaining equal, a propeller with a large pitch generates a stream that presents a greater flow rate and less turbulence than a stream generated by a propeller having a smaller pitch. Furthermore, other things remaining equal, a propeller having a larger diameter generates a stream presenting a flow rate that is greater than and more turbulent than a stream generated by a propeller of smaller diameter.

The first propeller (corresponding to the first stirrer) presents a greater diameter and a smaller pitch than the second propeller (corresponding to the second stirrer), such that the flow rate of the first propeller is substantially equal to the flow rate of the second propeller and the second propeller generates less turbulence in the second downward stream than the first propeller generates in the first downward stream. Thus, the flow rates of both downward streams are substantially equal, thereby ensuring continuity in the overall downward stream within the dispersion tube. Furthermore, since the second propeller generates less turbulence, it reduces dust dispersion. The first propeller, which is designed to be immersed, generates more turbulence, thereby encourages mixing of the powder and the dust with the liquid.

Advantageously, the dispersion tube further includes a dust exhaust orifice in its top portion.

The term "top portion" of the dispersion tube should be understood as the portion situated in the vicinity of the top end of the dispersion tube. Similarly, the term "bottom portion" of the dispersion tube should be understood as the portion situated in the vicinity of the bottom end of the dispersion tube.

This dust exhaust orifice enables the residual dust that is not entrained by the second stream to be evacuated from the cavity of the emergent portion of the dispersion tube. This dust exhaust orifice is preferably located above the powder delivery orifice, along the length of the tube. Thus, it is ensured that the powder delivered by the powder delivery orifice and moving down the dispersion tube under gravity and with the help of the second downward stream does not go close to the exhaust orifice and is not exhausted.

In order to avoid dispersing the residual dust in ambient air, the dust exhaust orifice may be connected to a filter sleeve, for example. The filter sleeve serves to collect the residual dust, and changing or cleaning the sleeve on a regular basis serves to avoid the sleeve becoming clogged and avoid residual dust accumulating in the emergent portion of the dispersion tube.

In a variant, the dust exhaust orifice is connected to a dust exhaust pipe. Preferably, said dust exhaust pipe is connected to a liquid feeder. Advantageously, the dust exhaust pipe opens out into the liquid feeder via a constriction zone downstream from a coupling between said feeder and a liquid supply pipe.

It can thus be understood that the dust exhaust orifice is connected via the dust exhaust pipe to the liquid feeder (which, for example, feeds a liquid vessel, channel, or pipe) upstream from the coupling between the feeder and the liquid supply pipe, and opens out via the constriction zone downstream from said liquid supply pipe.

The term "constriction zone" is used to designate a zone where the flow section for the liquid supply pipe into which the dust exhaust pipe opens out is reduced. In other words, a zone where a pipe of smaller section penetrates into a pipe of larger section constitutes a constriction zone.

Thus, when the liquid supply pipe feeds liquid to the liquid feeder, a Venturi effect occurs in the constriction zone, thereby creating suction in the constriction zone. This suction generates a suction stream that enables residual dust to be sucked from the dispersion tube towards the liquid feeder. The residual dust as sucked in this way is then directly entrained into the feeder by the liquid.

The invention also provides a mixing method for mixing powder or the like with a liquid, the method comprising the following steps: providing a dispersion tube having a bottom portion that is open; placing the bottom portion of the dispersion tube in a liquid; delivering powder or the like into the top portion of the dispersion tube and creating a first downward stream in the dispersion tube in the vicinity of its bottom end and in the liquid, the first downward stream tending to mix the powder or the like with the liquid; and further creating in the dispersion tube, a second downward stream in a region between the top end of the dispersion tube and the first downward stream.

In a first variant of the method, the dispersion tube is placed in such a manner that the first and second downward streams are both created in the liquid, whereas in a second variant of the method, the dispersion tube is placed in such a manner that the second downward stream is created above the liquid.

By implementing the method with a device of the invention, the first variant corresponds to the situation where both stirrers are immersed in the liquid, while the second variant corresponds to a situation in which the second stirrer is emergent while the first stirrer is immersed in the liquid.

Advantageously, any dust present in the top portion of the dispersion tube is exhausted via a dust exhaust pipe, and preferably the dust is exhausted with the help of a pressure difference between the two ends of the dust exhaust pipe, in particular a pressure difference due to the Venturi effect. Advantageously, it is then possible to use the dust exhaust pipe used to deliver a rinsing liquid into the dispersion tube.

Naturally, the method of the invention is advantageously implemented in a vessel, a channel, or a pipe containing liquid, in which the dispersion tube is located.

The device and the method of the invention are particularly adapted to mixing in a liquid a powder of grain size that is less than one millimeter (1 mm) and of apparent relative density that is less than two (2).

BRIEF DESCRIPTION OF THE DRAWINGS

The invention and its advantages can be better understood on reading the following detailed description of an embodiment given by way of non-limiting example. The description refers to the sheets of the accompanying drawings, in which.

MORE DETAILED DESCRIPTION

Figure 1:
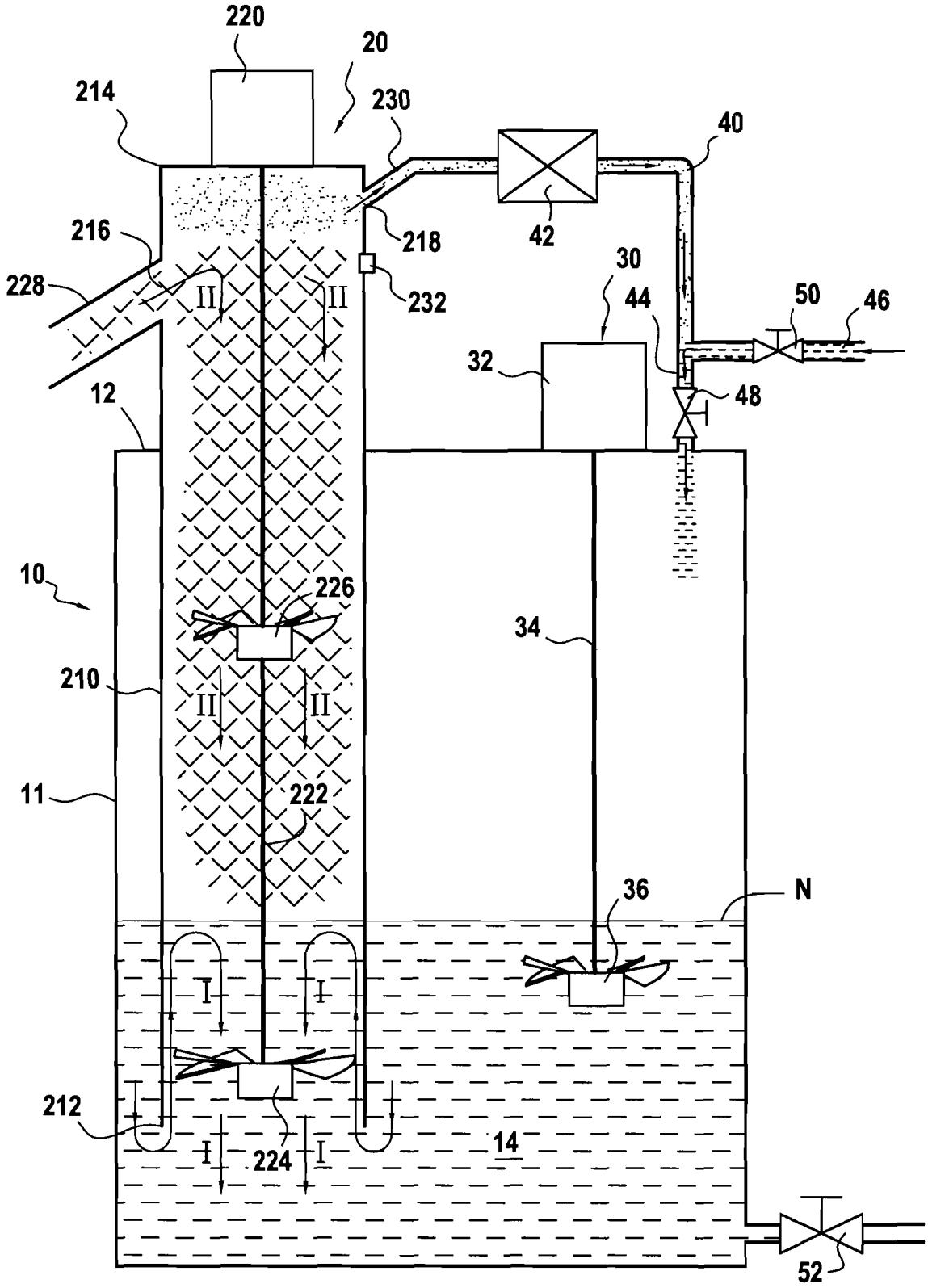
FIG. 1 is a section view showing an embodiment of the mixture device of the invention for mixing powder with a liquid, the first stirrer being immersed.
Figure 2:
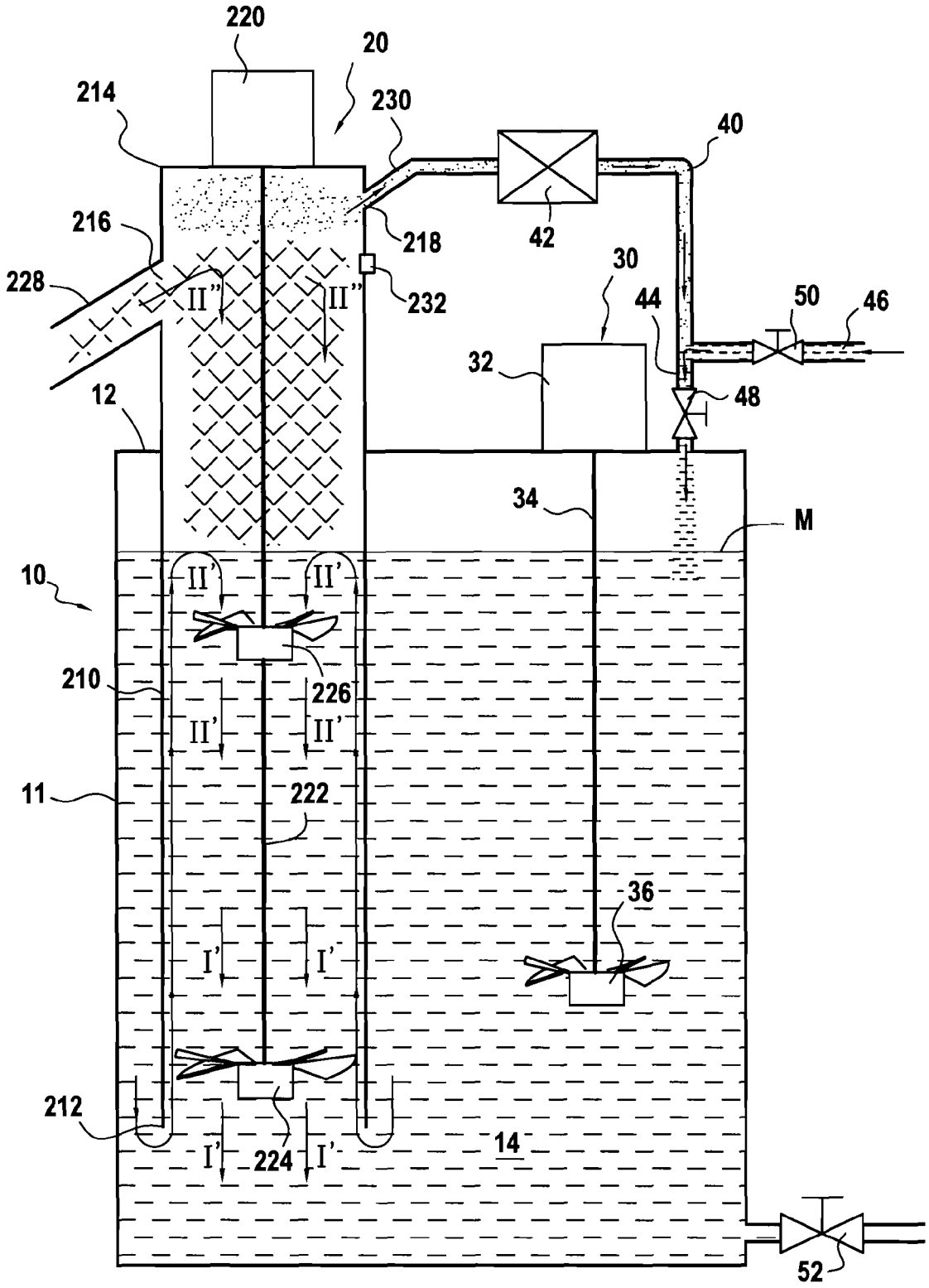
FIG. 2 shows the FIG. 1 mixture device, both stirrers being immersed.

FIGS. 1 and 2 show an embodiment of the invention in section. It should be observed that FIGS. 1 and 2 are diagrammatic and that the relative dimensions of each element are not necessarily complied with.

In this example, the mixer device 10 comprises a vessel 11 closed by a cover 12 having fastened thereto a dispersion tube 20 and a second mixer 30.

The dispersion tube 20 (or mixer tube) is constituted by a straight vertical tube 210 that is open at its bottom end 212 and closed, at its top end 214, preferably hermetically, with the exception of orifices 216 and 218 that are described below and that are present in the top portion of the dispersion tube 20. It should be observed that in operation the powder and the liquid present in the pipework circuit described below contributes to the hermetically-sealed aspect of the top end 214. The bottom end 212, and more generally the bottom portion of the dispersion tube 20, is plunged in a liquid 14 contained within the enclosure defined by the vessel 11. The top portion of the dispersion tube 20 projects beyond the cover 12 and presents a powder delivery orifice 216 and a dust exhaust orifice 218. The top end 214 supports a motor 220 for driving propellers. The motor 220 rotates a common drive shaft 222 having mounted thereon a first propeller 224 and a second propeller 226. The top portion of the dispersion tube 20 is fitted with a sensor 232 for detecting the presence of an undesired mass of material, generally powder and dust, in order to avoid problems of clogging. For example, the sensor 232 may be a capacitive sensor.

The vertical tube 210 is fabricated in three portions (not distinguished in the figures):

- a high portion constituted by all of the tube 210 located outside the vessel 11 above the cover 12, i.e. the top portion of the tube 210 with the powder delivery and dust exhaust connections 228 and 230;
- an intermediate portion passing through the cover 12 of the vessel 11; and
- a bottom portion constituted by all of the tube 210 located inside the vessel 11, beneath the cover 12.

A powder delivery connection 228 connects a powder delivery device, described elsewhere and not shown, to the powder delivery orifice 216. For example, the powder delivery device may be a wormscrew device.

A dust exhaust connection 230 connects the dust exhaust orifice 218 to a dust exhaust pipe 40. This dusts exhaust pipe 40 is fitted with a filter 42. By way of example, the filter 42 is a water filter serving to filter the dust contained in a gas such as air.

The powder delivery connection 228 is inclined so that the powder delivery device is at a level that is lower than the powder delivery orifice 216. The dust exhaust connection 230 is inclined so that the dust exhaust pipe 40 is higher than the dust exhaust orifice 218. This limits deposition of powder and dust at the junctions between the tube and the connections. Furthermore, this serves to limit stagnation of the liquid that, in the long run, could amalgamate with the powder and the dust and run the risk of obstructing the connection.

The dust exhaust pipe 40 is connected to a feeder 44 for feeding liquid to the vessel 11. A liquid supply pipe 46 is also connected to the feeder 44. The feeder 44 and the liquid supply pipe 46 are fitted with respective valves 48 and 50 serving to allow or prevent liquid to be fed to the vessel 11 or to the feeder 44. The feeder 44 opens out directly into the vessel 11 via the cover 12. The vessel 11 is also fitted with a draw-off valve 52 for drawing off the liquid 14 from the vessel 11.

The secondary mixer 30 presents a motor 32 fastened to the cover 12 of the vessel, and acting via a shaft 34 to drive a propeller 36 located inside the enclosure of the vessel 11. The secondary mixer 30 is intended to homogenize the liquid 14 inside the enclosure of the vessel 11. Furthermore, the mixer 30 serves to avoid any powder that is not completely dissolved in the liquid 14 becoming deposited on the bottom of the vessel 11. It should be observed that the operation of the secondary mixer 30 is decoupled from the operation of the dispersion tube 20. Thus, the secondary mixer 30 may operate simultaneously with the dispersion tube 20, or it may be switched off. Similarly, the secondary mixer 30 may operate while the dispersion tube 20 is not operating.

Figure 3:
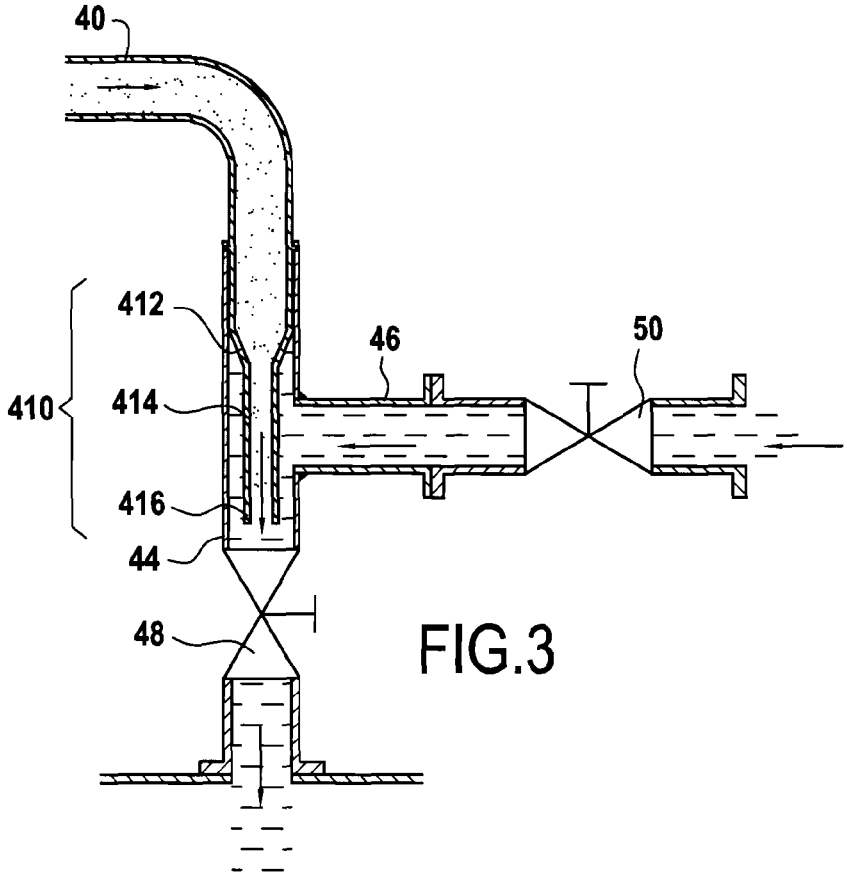
FIG. 3 is a section view showing the connections upstream from the feeder for feeding liquid to the vessel of FIG. 1 with the valve of the feeder being open.
Figure 4:
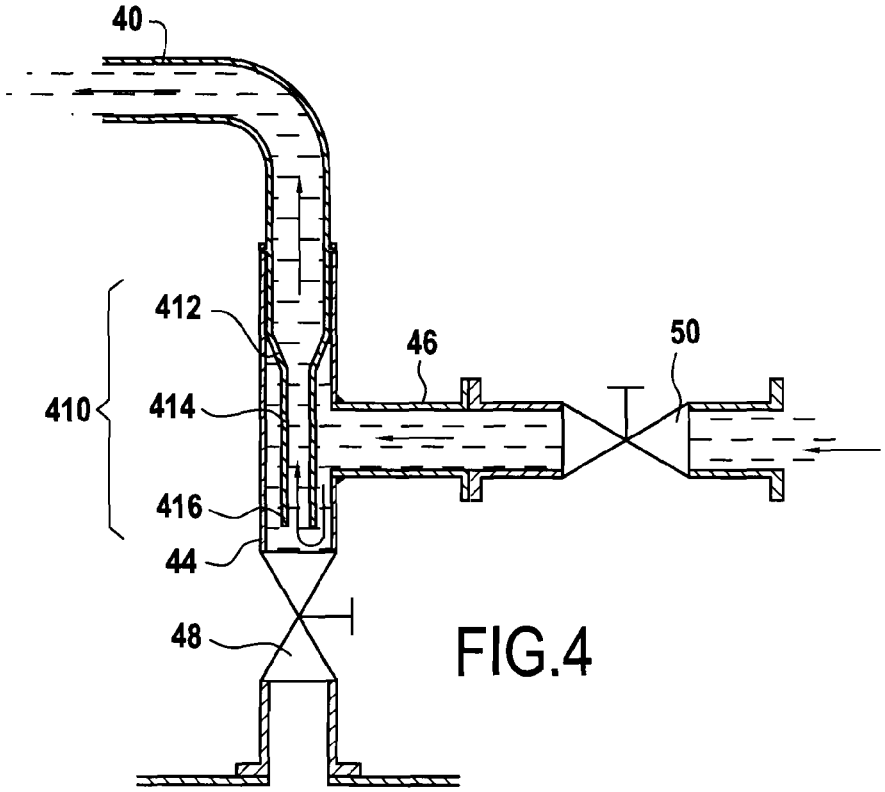
FIG. 4 is a section view showing the connections upstream from the feeder for feeding liquid to the vessel of FIG. 1 with the valve of the feeder being closed.

FIGS. 3 and 4 show the couplings between the feeder 44, the dust exhaust pipe 40, and the liquid supply pipe 46. The dust exhaust pipe 40 is connected to the feeder 44 upstream from the coupling between the liquid supply pipe 46 and the feeder 44. Inside the feeder 44, the dust exhaust pipe 40 is extended by a constriction zone 410 constituted by a cone 412 that converges downstream, followed by a tube 414 of diameter that is smaller than the diameter of the dust exhaust pipe 40. The tube 414 opens out into the feeder 44 downstream from the coupling between the liquid supply pipe 46 and the feeder 44. In addition, the constriction zone 410 of the dust exhaust pipe 40 also constitutes a constriction zone for the flow section of the liquid supply pipe 46. The section of the feeder 44 and the section of the liquid supply pipe 46 are substantially equal, so the presence of the tube 414 inside the feeder 44 reduces the flow section of the liquid supply pipe 46 to the section of the feeder 44 minus the section of the tube 414.

Thus, when the liquid from the liquid supply pipe 46 reaches this constriction zone, the law of conservation of mass requires the speed of the liquid to increase. This increase in the speed of the liquid generates suction at the free end 416 of the tube 414. This suction drives a suction flow from the dispersion tube 20 towards the feeder 44.

Thus, when the vessel 11 is fed with liquid via the liquid supply pipe 46, a suction stream is generated in the constriction zone 410 that serves to suck any powder-derived dust that might be present in the emergent portion of the dispersion tube 20.

Furthermore, the valve 48 constitutes a selector member that directs the flow from the liquid supply pipe 46 towards the dispersion tube 20 via the dust exhaust pipe 40, or towards the liquid feeder 44 (liquid feeder nozzle 44) of the vessel 11.

If the valve 48 is open, as shown in FIG. 3, the liquid arriving from the liquid supply pipe 46 is directed by gravity towards the vessel 11. Conversely, if the valve 48 is closed, as shown in FIG. 4, the liquid arriving from the liquid supply pipe 46 is deflected by the closed valve 48 into the tube 414. Thus, when the valve 48 is closed, the arriving liquid is directed towards the dispersion tube 20. This operation thus makes it easy to rinse the dust exhaust pipe 40, the filter 42, and the dispersion tube 20.

Two operating regimes for the mixer device 10 are described below with reference to FIGS. 1 and 2. The arrows represent the streams of powder, liquid, and dust. The first and second propellers 224 and 226 are in rotation, the valve 48 of the feeder 44 and the valve 50 of the liquid supply pipe 46 are open, and the draw-off valve 52 is closed.

The liquid 14 in the vessel is represented by zones shaded with horizontal dashes. There can thus be distinguished portions that are immersed and portions that are emergent. The cross-hatched zone symbolizes powder and the dotted zone symbolizes residual dust.

In FIG. 1, the level N of the liquid lies between the first propeller 224 and the second propeller 226.

The first propeller 224 generates a downward stream I. Thus, the liquid 14 that is situated at the surface in the immersed portion of the dispersion tube 20 follows the arrows I and is directed towards the enclosure of the vessel 11. In addition, fluid outside the dispersion tube 20 rises along the dispersion tube 20 and passes through the empty space between the propeller 224 and the wall of the tube 210 so as to replace the surface liquid in the immersed portion of the dispersion tube 20.

The second propeller 226 generates a second downward stream II in the emergent portion of the dispersion tube 20. The powder and the dust are then forced along arrows II towards the surface of the liquid 14. Thus, the liquid at the surface in the immersed portion of the dispersion tube 20 comes into contact with the powder and the dust, mixes with the powder and the dust, and is then directed into the enclosure of the vessel 11 by the first stream I. In other words, the first downward stream I creates a powder/liquid mixing interface, and the second downward stream II creates forced conveyance of the powder towards the powder/liquid mixing interface.

Residual dust (dotted zone), in suspension above the volume of powder (cross-hatched zone), is sucked through the dust exhaust orifice 218 by the Venturi effect created by liquid arriving in the feeder 44. The liquid that flows from the feeder 44 is thus loaded with any dust that is not filtered by the filter 42.

In FIG. 2, the level M of the liquid is above the second propeller 226.

The first propeller 224 generates a first downward flow I' extending the second downward flow II' as generated by the second propeller 226. In a manner similar to FIG. 1, the fluid outside the dispersion tube 20 rises up inside the tube and passes via the empty spaces between the wall of the tube 210 and the propeller 224 and 226. This outside fluid renews the fluid at the surface of the immersed portion of the dispersion tube 20, becomes loaded with powder and dust, and is redirected towards the enclosure of the vessel along the downward streams II' and I'. In other words, the first downward stream I' forcibly conveys the liquid present in the dispersion tube 20 towards the enclosure of the vessel 11, and the second downward stream II' creates a powder/liquid mixing interface.

The powder is delivered by gravity to the surface of the liquid along arrows II". In the same as in FIG. 1, the residual dust is sucked through the dust exhaust orifice 218.

Advantageously, in order to improve the mixing of the powder and the dust with the liquid, the emergent portion of the dispersion tube 20 is maintained at atmospheric pressure, i.e. at the pressure outside the dispersion tube 20, with this being done preferably with the help of the dust exhaust orifice. When powder is introduced into the dispersion tube 20 via the powder delivery orifice 216, or when the level of liquid rises in the dispersion tube 20, the pressure in the emergent portion of the dispersion tube 20 may tend to increase, which can impede mixing of the powder and the dust with the liquid. It is then advantageous to regulate the pressure in the emergent portion of the dispersion tube 20. The opening constituted by the dust exhaust orifice may serve to maintain the pressure inside the emergent portion of the dispersion tube 20 at atmospheric pressure and serve to avoid the pressure rising, which would be harmful to mixing the powder with the liquid. The filter 42 then serves to prevent the dust from dispersing in the ambient atmosphere. Furthermore, the suction for exhausting the dust via the dust exhaust orifice improves maintaining the pressure in the emergent portion of the dispersion tube 20 at atmospheric pressure.

What is claimed is:

1. A mixer device for mixing powder or the like with a liquid, the device comprising both a dispersion tube having its bottom portion open and designed to be in the liquid and having a delivery orifice for powder or the like in its top portion, and mixer means located in the dispersion tube and comprising a first rotary stirrer disposed in the vicinity of the bottom end of the dispersion tube and suitable for creating a first downward stream in said dispersion tube, wherein the mixer means further comprises a second rotary stirrer disposed between the delivery orifice for powder or the like and the first rotary stirrer, and suitable for creating a second downward stream in said dispersion tube, wherein the dispersion tube further includes a dust exhaust orifice in its top portion, wherein the dust exhaust orifice is connected to a dust exhaust pipe, wherein said dust exhaust pipe is connected to a liquid feeder, and wherein the dust exhaust pipe opens out into the liquid feeder via a constriction zone downstream from a coupling between said feeder and a liquid supply pipe.

2. A mixer device according to claim 1, further comprising a vessel for containing the liquid, the bottom portion of the dispersion tube being open in the vessel.

3. A mixer device according to claim 1, wherein both rotary stirrers are driven by a common drive shaft.

4. A mixer device according to claim 1, wherein at least one of the rotary stirrers is a propeller.

5. A mixer device according to claim 1, wherein a selector member directs the stream flowing from the liquid supply pipe towards the dispersion tube via said dust exhaust pipe, or towards the liquid feeder.

6. A mixer device according to claim 1, wherein the dust exhaust pipe is fitted with a filter.

7. A mixer device according to claim 1, wherein both rotary stirrers are propellers.

8. A mixer device according to claim 7, wherein the pitch of the first propeller is smaller than the pitch of the second propeller.

9. A mixer device according to claim 7, wherein the diameter of the first propeller is larger than the diameter of the second propeller.

10. A mixing method for mixing powder or the like with a liquid, the method comprising the following steps:

providing a dispersion tube having a bottom portion that is open;

placing the bottom portion of the dispersion tube in a liquid;

delivering powder or the like into the top portion of the dispersion tube and creating a first downward stream in the dispersion tube in the vicinity of its bottom end and in the liquid, the first downward stream tending to mix the powder or the like with the liquid; and creating in the dispersion tube, a second downward stream in a region between the top end of the dispersion tube and the first downward stream, wherein any dust present in the top portion of the dispersion tube is exhausted via a dust exhausted pipe.

11. A mixing method according to claim 10, wherein the dispersion tube is placed in such a manner that the first and second downward streams are created in the liquid.

12. A mixing method according to claim 10, wherein the dispersion tube is placed in such a manner that the second downward stream is created above the liquid.

13. A mixing method according to claim 10, wherein the dust is exhausted with the help of a pressure difference between the two ends of the dust exhaust pipe.

14. A mixing method according to claim 13, wherein the pressure difference is due to the Venturi effect.

15. A mixing method according to claim 10, wherein the dust exhaust pipe is used to deliver a rinsing liquid into the dispersion tube.

16. A mixer device for mixing powder or the like with a liquid, the device comprising both a dispersion tube having its bottom portion open and designed to be in the liquid and having a delivery orifice for powder or the like in its top portion, and mixer means located in the dispersion tube and comprising a first rotary stirrer disposed in the vicinity of the bottom end of the dispersion tube and suitable for creating a first downward stream in said dispersion tube, wherein the mixer means further comprises a second rotary stirrer disposed between the delivery orifice for powder or the like and the first rotary stirrer, and suitable for creating a second downward stream in said dispersion tube, wherein said dispersion tube further comprises a dust exhaust orifice in its top portion, and wherein the first and the second rotary stirrers are propellers, the pitch of the first propeller being smaller than the pitch of the second propeller.

17. A mixer device according to claim 16, further comprising a vessel for containing the liquid, the bottom portion of the dispersion tube being open in the vessel.

18. A mixer device according to claim 16, wherein the first and the second rotary stirrers are driven by a common drive shaft.

* * * * *